United States Patent [19]

Elkin

[11] Patent Number: 4,755,059

[45] Date of Patent: Jul. 5, 1988

[54] AUGER SWIVEL FOR CONCRETE MIXER

[76] Inventor: Luther V. Elkin, 1423 Florence Ave., Indiana, Pa. 15701

[21] Appl. No.: 91,076

[22] Filed: Aug. 31, 1987

[51] Int. Cl.[4] ..... B28C 7/00

[52] U.S. Cl. ..... 366/26; 74/105; 74/106; 193/10; 193/16; 366/27; 366/33; 366/41; 366/61; 366/68

[58] Field of Search ..... 366/26, 27, 30, 33, 366/41, 42, 44, 50, 61, 68, 56, 60, 64, 68, 6, 10, 13, 62, 77, 79, 96–99, 184, 186, 194–196, 318, 606; 74/99 R, 102, 105, 106; 193/10, 16, 15, 23; 91/180, 182, 186

[56] References Cited

U.S. PATENT DOCUMENTS

| | | | |
|---|---|---|---|
| 2,717,769 | 9/1955 | Masek | 193/10 |
| 2,968,382 | 1/1961 | Oury | 193/10 |
| 3,035,411 | 5/1962 | Porowski | 74/106 |
| 3,097,750 | 7/1963 | Stummer | 74/105 |
| 3,402,805 | 9/1968 | Spellman, Jr. | 366/61 X |
| 3,410,538 | 11/1968 | Potter | 366/68 |
| 4,403,864 | 9/1983 | Stastny | 366/50 X |
| 4,441,821 | 4/1984 | Burkhart et al. | 366/61 |
| 4,454,781 | 6/1984 | Orii | 74/99 R |
| 4,551,024 | 11/1985 | Clapp | 366/50 X |
| 4,586,824 | 5/1986 | Haws | 366/68 X |

*Primary Examiner*—Timothy F. Simone

*Attorney, Agent, or Firm*—Webb, Burden, Ziesenheim & Webb

[57] ABSTRACT

An auger swivel for a concrete mixer includes a channel mounted to a bowl. A center member is pivotally connected to a pivot point near the channel and near an outer surface of the bowl. The center member includes a pair of first wings that extend from the pivot point, opposite each other and away form the bowl. Two slides are received in the channel and are positioned away from each other by a ring. Two second wings are provided. One of the second wings is pivotally connected to one of the first wings at one of its ends and pivotally connected to one of the slides at its other end. The other second wing is similarly connected to the other first wing and the other slide. An actuator rotates the center member about the pivot point and causes the slides to rotate around the outer surface of the bowl and about a longitudinal axis passing through the bowl.

21 Claims, 5 Drawing Sheets

AUGER SWIVEL FOR CONCRETE MIXER

BACKGROUND OF THE INVENTION (1) Field of the Invention

This invention relates to concrete mixers and more particularly, to an auger swivel for concrete mixers.

(2) Description of the Prior Art

Concrete mixers mounted to the chassis of vehicles are known in the art. These concrete mixers make concrete by mixing aggregate, cement and water together in either one mixing bin, mixing augers, or by other mixing apparatuses. The mixers travel to one or more work sites and selectively deposit a predetermined amount of concrete at each site. A dispensing trough or a mixing auger usually is positioned manually or mechanically over the work site so that the concrete can be properly dispensed, depending on the size and weight of the trough or mixing auger.

A mechanically positioned mixing auger, for example, usually includes both a device to raise and lower a dispensing end of the mixing auger and a swivel to rotate the dispensing end into place. A gear and chain driven mechanism is commonly used to rotate the mixing auger for positioning the dispensing end of the mixing auger. The gears tend to wear quickly since hardened concrete adheres to the chain causing excessive wear to the gear teeth. Furthermore, the chain tends to stiffen as the hardened concrete accumulates on the chain. This causes an increase in the amount of torque required to rotate the gear chain. Typically, an electric motor is used to turn the chain. The increase in required torque can easily stall the motor and limit the useful life of the motor.

Therefore, it is an object of this invention to increase the operating life and reduce the maintenance of a swivel over that of the prior art.

It is a feature of this invention to have a linkage arrangement, rather than a gear and chain mechanism to drive the swivel. This permits improved operating performance in a dirty environment.

It is an advantage of this invention that when concrete adheres to the linkage, the swivel is much less affected than that of the prior art.

SUMMARY OF THE INVENTION

I have invented a swivel that rotates about a longitudinal axis passing through a cylindrically-shaped object such as a bowl and includes a channel attached to and extending substantially around the bowl. A center member is pivotally connected to a pivot point near the channel and an outer surface of the bowl. The center member includes a pair of integral first wings extending from the pivot point. The first wings are positioned opposite each other and away from the bowl. Slides are received in the channel and are positioned away from each other by appropriate means for separation, such as a ring.

Two second wings each having two ends are also provided. One of the second wings is pivotally connected at one of its ends to one of the first wings and pivotally connected at its other end to one of the slides. Likewise, the other second wing is similarly attached to the other first wing and other slide.

The center member is rotated about the pivot point by an actuator, such as a motor, hydraulic cylinder, or any other device which can rotate the center member. This causes the slides to rotate around the outer surface of the bowl and about the longitudinal axis passing through the bowl. Preferably the two slides are attached to a ring that is slidably received by the channel.

In one embodiment the channel includes an upper bearing plate spaced from a lower bearing plate so that the two slides are slidably received between the upper bearing plate and the lower bearing plate.

The first wings of the center member and each of the second wings can have an inner surface in the shape of an arc of a circle approximately equal to or greater than the outer diameter of the cylindrical bowl.

DESCRIPTION OF THE PREFERRED EMBODIMENT

Figure 1:
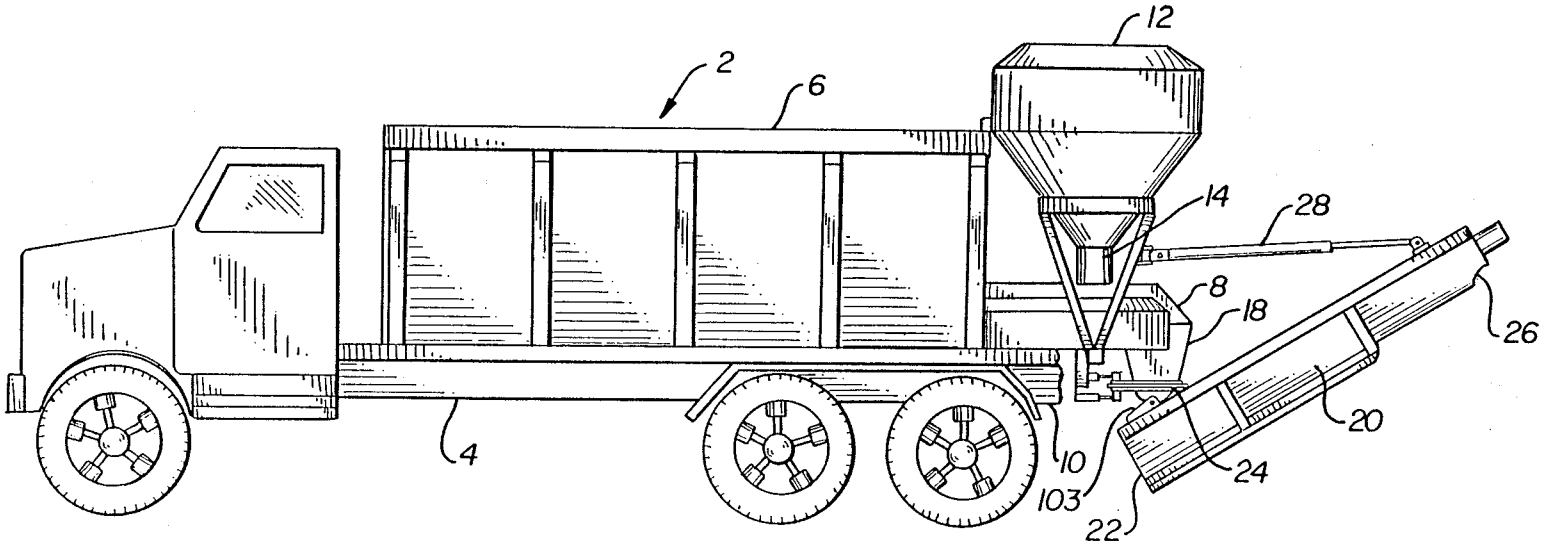
FIG. 1 is a side view of a concrete mixer having an auger swivel in accordance with the present invention.
Figure 2:
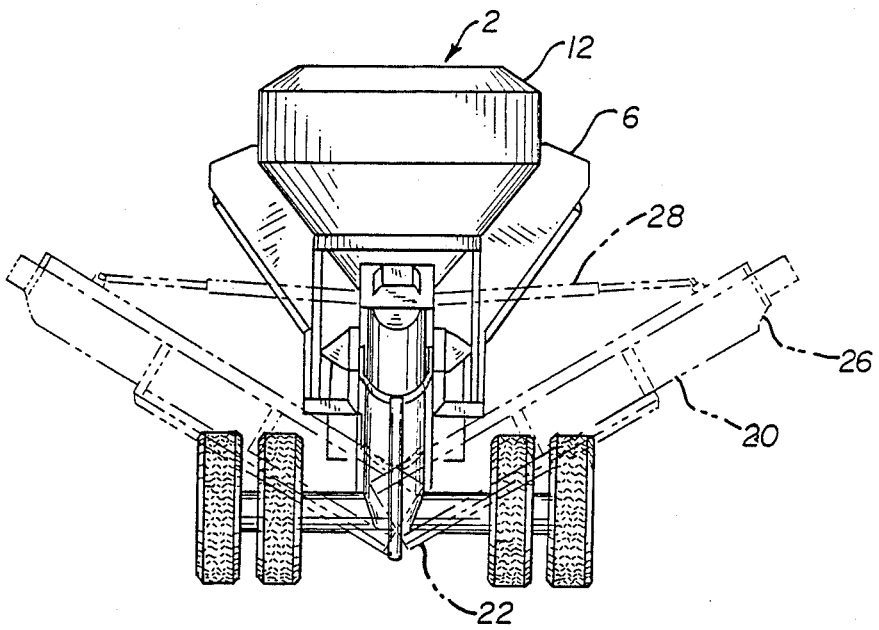
FIG. 2 is a rear view of the mixer shown in FIG. 1.

A concrete mixer having an auger swivel in accordance with the present invention is shown in FIGS. 1 and 2. The concrete mixer 2 includes a chassis 4, and an aggregate bin 6 that is mounted to a forward portion of the chassis 4. The aggregate bin 6 contains aggregate, such as gravel or sand, which is mixed with other materials to make concrete. The aggretate bin 6 may have an open or closed top and also have downwardly sloping sides to direct the aggregate to a conveyor 8 or the like extending through the bottom of the aggregate bin 6.

The conveyor 8 moves the aggregate toward a rear end 10 of the chassis 4 and is positioned below a cement bin 12 mounted to the chassis 4. The cement bin 12 contains cement, which is mixed with the aggregate, and has a closed top and downwardly sloping sides to direct the cement to a cement dispenser, such as a metering wheel 14, at a lower end thereof. The metering wheel 14 dispenses the cement onto the conveyor 8 which is positioned below and in fluid communication with the metering wheel 14.

Figure 3:
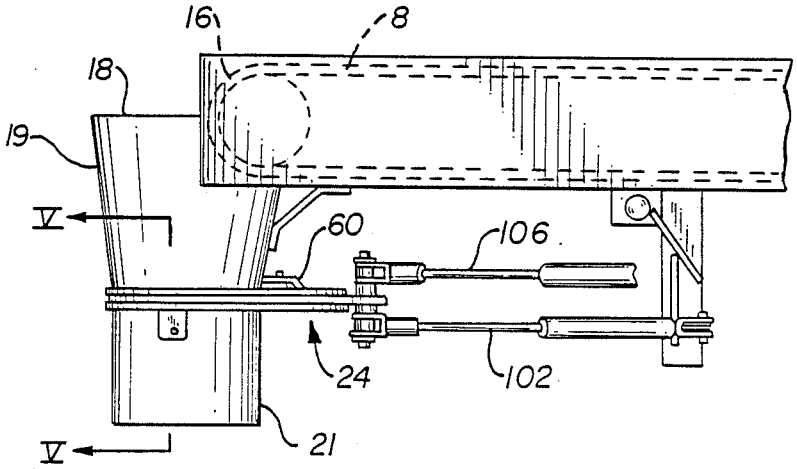
FIG. 3 is a side view of a portion of the mixer shown in FIG. 1.

The conveyor 8, shown in more detail in FIG. 3, carries the cement and the aggregate toward a conveyor dispensing end 16 which is above and in fluid communication with a hollow bowl 18. The bowl 18 has a frusto-cylindrically shaped top section 19. The bottom of the top section of the bowl 18 is connected to a cylindrically-shaped bottom section 21. A mixing auger 20 has its receiving end 22 positioned directly below and in fluid communication with the bowl 18. Accordingly, the aggregate and cement mixture travels from the dispensing end 16 of the conveyor 8, through the bowl 18, and then into the receiving end 22 of the mixing auger 20. In the mixing auger 20 water is added by a water dispenser whereby the water, aggregate, and cement are mixed by the mixing auger 20 so that concrete may be dispensed at a work site.

An auger swivel 24, in accordance with the present invention, is mounted to the bowl 18. The mixing auger 20 is pivotally connected to the auger swivel 24 at a point near the receiving end 22 of the mixing auger 20. This enables the mixing auger 20 to be rotated about its receiving end 22 by the auger swivel 24 so that a dispensing end 26 of the mixing auger 20 may be positioned as desired over the work site. The dispensing end 26 may then be lowered to the work site by any device which can raise and lower the dispensing end of the mixing auger 28, such as a hydraulic cylinder 28. The hydraulic cylinder 28 has one end attached to the mixing auger 20 near the dispensing end 26 and another end attached to the cement bin 12 or any other rigid location on the concrete mixer 2. When activated the hydraulic cylinder 28 is either extended or retracted causing the dispensing end 26 of the mixing auger 20 to either be lowered or raised.

Figure 4:
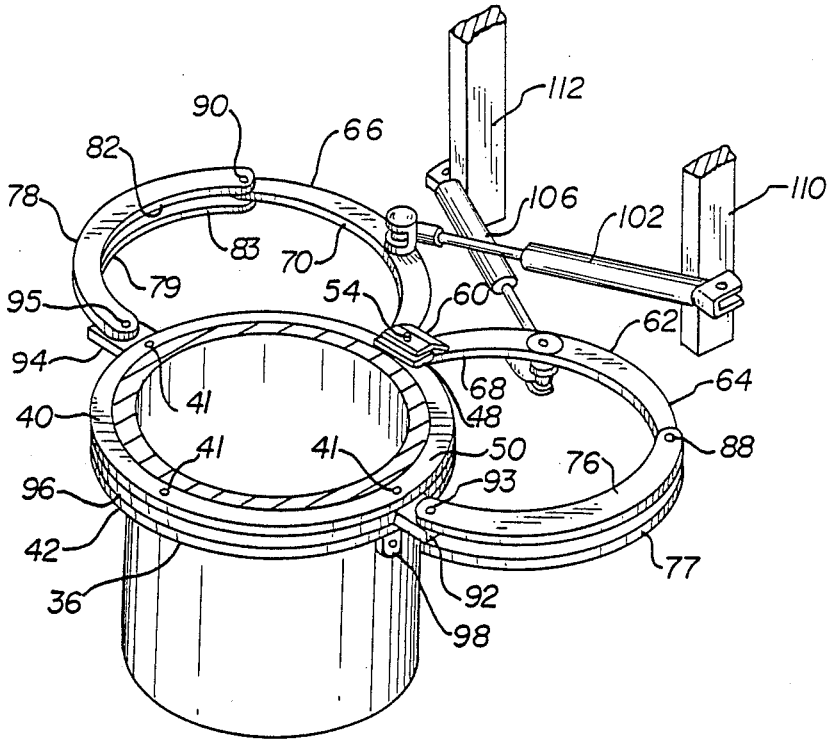
FIG. 4 is a perspective view, partially in section, of the auger swivel shown in FIG. 3.
Figure 5:
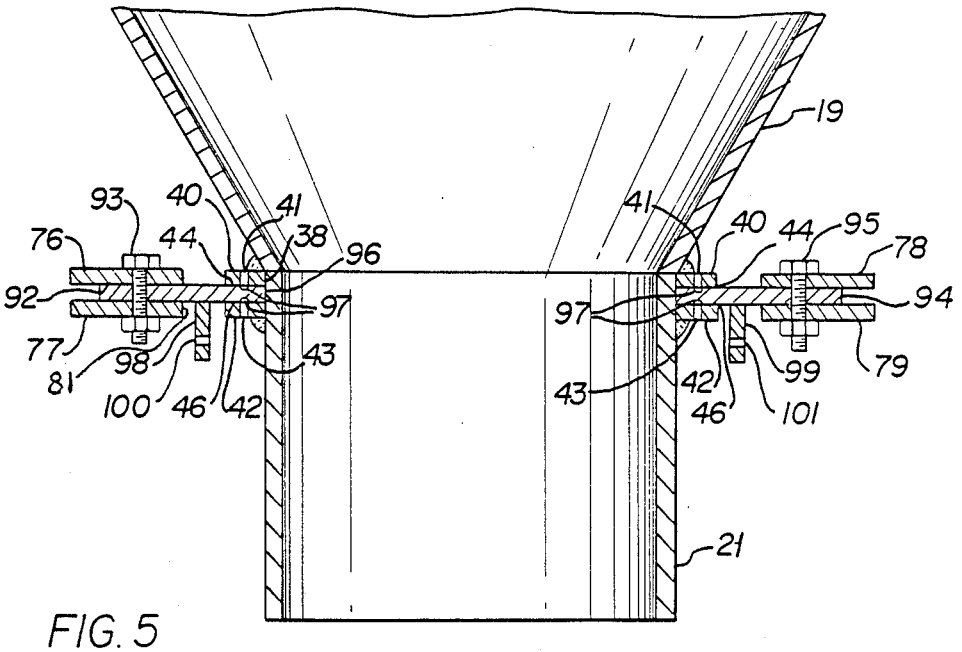
FIG. 5 is a section taken along lines V—V in FIG. 3.

FIGS. 4 and 5 show the auger swivel 24 mounted to the bowl 18. A channel 36 having a cylindrical shape and an inside diameter that is approximately the same as the outer diameter of the bottom section 21 of the bowl 18 is mounted to an outside surface 38 of the bottom section 21 that is located near the interface of the top section 19 and bottom section 21 of the bowl 18. The channel 36 is defined by a circular-shaped upper bearing plate 40 having a plurality of holes 41 therethrough spaced above a circular-shaped lower bearing plate 42 having a plurality of holes 43 therethrough. The upper bearing plate 40 has a substantially flat inner bearing surface 44 facing a substantially flat inner bearing surface 46 of bearing plate 42.

A support plate 48 is mounted onto a top surface 50 of the channel 36. The support plate also extends outwardly from channel 36 and faces the front end of the chassis 4. The support plate 48 has a bore (not shown) therethrough that is positioned away from channel 36. A pivot pin 54 is received by the bore of support plate 48. The pivot pin 54 is also received by a bore (not shown) of an outwardly extending support member 60 which rests on a top surface of support plate 48. The support member 60 is also centrally positioned on a top surface of a center member 62 and welded thereto. Typically the pivot pin 54 is a threaded bolt having a head, although any type of fastener which permits rotation will do. The threaded bolt 54 is received by the bore of the support plate 48, the bore of the support member 60 and a centrally located bore 63 of the center member 62, respectively. A nut (not shown) is received by the threaded bolt 54 and sufficient torque is applied to the nut/bolt combination so that the head of the bolt 54 and the nut sandwich the support plate 48, between the support member 60 and the center member 62. This enables the support member 60 and the center member 62 to rotate about an axis that passes through the bolt 54 and is parallel to the longitudinal axis passing through the bowl 18.

Figure 6:
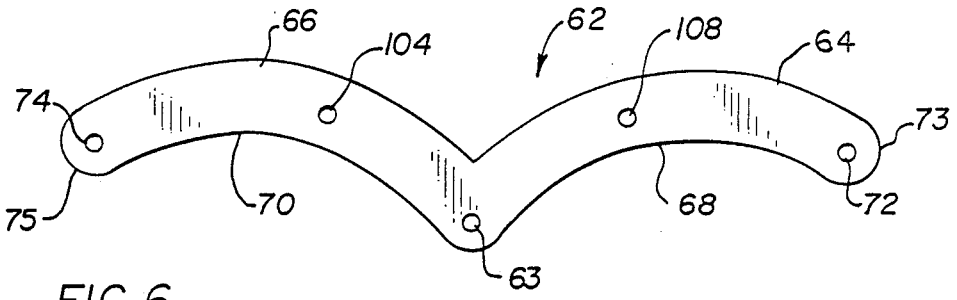
FIG. 6 is a top view of the center member of the auger swivel shown in FIG. 4.

The center member 62, as shown in FIG. 6, includes a pair of integral first wings 64 and 66. First wings 64 and 66 are arcuate shaped and extend from the center of the center member 62 away from the bowl 18. Also first wing 64 is a mirror image of first wing 66 about the center of the center member 62. More particularly, first wings 64 and 66 are in the shape of arcs of a circle. In this case, the inner surfaces 68 and 70 of first wings 64 and 66 have a radius larger than that of the outer surface of the bottom section 21 of the bowl 18. Each first wing 64 and 66 spans a radial distance of approximately 90 degrees. Bores 72 and 74 are positioned at opposite ends 73 and 75 of the center member 62 on first wings 64 and 66, respectively. Also, the centrally located bore 63 is equidistance from bores 72 and 74.

Figure 7:
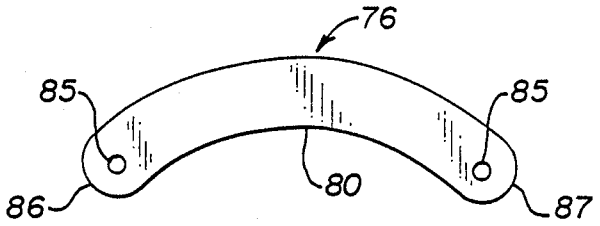
FIG. 7 is a top view of a second wing of the auger swivel shown in FIG. 4.

Each first wing 64 and 66 is sandwiched at its ends 73 and 75 by a set of arcuate shaped second wings 76, 77 and 78, 79, respectively. Second wing 76 is shown in FIG. 7 and includes a bore 85 located near each end 86 and 87 thereof. Second wings 77–79, though not shown, are identical to second wing 76. Like the first wings, inner surfaces 80–83 of second wings 76–79, respectively, have circular radii larger than the radius of the outer surface of the bottom section 21 of the bowl 18. Each second wing spans a radial distance of approximately 90 degrees.

Second wing 76 is positioned above first wing 64 and second wing 77 is positioned below first wing 64. Also, second wing 76 is positioned parallel to second wing 77 and the inner surface 68 of first wing 64 faces the inner surfaces 80 and 81 of second wings 76 and 77, respectively. Pivot pin 88 attaches the adjacent ends of the second wings 76 and 77 to the end 73 of first wing 64 by passing through the appropriate bores. The pivot pin 88 may be a threaded bolt having its head rest on a top surface of second wing 76. The bolt 88 also threadably receives a nut (not shown) that rests on a bottom surface of second wing 77 at its outer end. Likewise, second wing 78 is positioned above first wing 66 and second wing 79 is positioned below first wing 66. Second wing 78 is positioned parallel to second wing 79 and the inner surface 70 of first wing 66 faces the inner surfaces 82 and 83 of second wings 78 and 79, respectively. Pivot pin 90 attaches the adjacent end of second wings 78 and 79 to the end 75 of first wing 66 through the appropriate bores. The pivot pin 90 may be a threaded bolt having its head resting on a top surface of second wing 78. The bolt 90 also threadably receives a nut that rests on a bottom surface of second wing 79.

The other ends of second wings 76 and 77 sandwich and are pivotally connected to a tab 92. The tab 92 extends outwardly from the channel 36 and has a bore therethrough. A pivot pin 93, similar to that of the pivot pin 88 is used to connect second wings 76 and 77 to the tab 92 through the appropriate bores. Likewise, the other ends of second wings 78 and 79 sandwich and are pivotally connected to a tab 94. The tab 94 extends outwardly from the channel 36 and has a bore therethrough. A pivot pin 95, similar to that of the pivot pin 90, is used to connect second wings 78 and 79 to the tab 94 through the appropriate bores.

A cylindrically-shaped sliding member 96 whose inner diameter is slightly larger than the outer diameter of the bottom section 21 of the bowl 18 is slidably received between upper bearing plate 40 and lower bearing plate 42. Tabs 92 and 94 are integrally attached to the sliding member 96 and extend outwardly therefrom. Also, tabs 92 and 94 are spaced on the sliding member 96 approximately 180 degrees apart.

The sliding member 96 has two circular grooves 97, one is located on an upper surface of the sliding member 96, and is adjacent to the upper bearing plate 40 and the other groove 97 is located on a lower surface of sliding member 96 and is adjacent to the lower bearing plate 42. The holes 41 and 43 of the upper bearing plate 40 and lower bearing plate 42, respectively, are in fluid communication with the grooves 97 of the sliding member 96. This permits lubricant to be urged through the holes 41 and 43 and accumulate in the grooves 97 so that the sliding member 96, upper bearing plate 40, and lower bearing plate 42 are easily and properly lubricated.

A vertically positioned flat ear 98 and 99 is located on a bottom surface of each of the tabs 92 and 94. Like the tabs 92 and 94, the ears 98 and 99 are spaced approximately 180 degrees apart from each other. Also, each of the ears 98 and 99 has a bore 100 and 101, respectively, therethrough. The mixing auger 20 also has two ears 103, of which only one is shown in FIG. 1, positioned on an upper edge of each side of the mixing auger 20 near the receiving end 22 of the mixing auger 20. Pivot pins, such as pivot pin 88, are used to pivotally attach the mixing auger ears 103 to the ears 98 and 100 through the appropriate bores.

A hydraulic cylinder 102 is pivotally attached at one end to an upper surface of first wing 66 through a centrally located bore 104 of first wing 66. A hydraulic cylinder 106 is pivotally attached at one end to a bottom surface of first wing 64 through a centrally located bore 108 of first wing 64. Hydraulic cylinders 102 and 106 criss-cross one another with hydraulic cylinder 102 above hydraulic cylinder 106. The other end of hydraulic cylinder 102 is pivotally mounted to a downwardly extending bracket 110 by appropriate hardware. Likewise, the other end of hydraulic cylinder 104 is pivotally mounted to a downwardly extending bracket 112 by appropriate hardware. Brackets 110 and 112 are parallel to each other and extend from and are rigidly secured to the chassis 4 of the concrete mixer 2. Although not shown, hydraulic cylinders 102 and 106 are controlled in a manner well known in the art.

Figure 8:
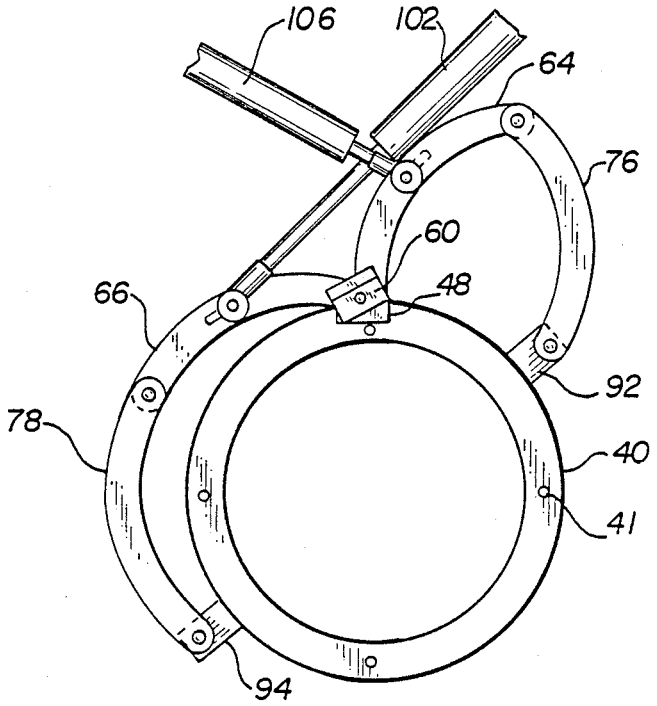
FIG. 8 is a top view of the auger swivel shown in FIG. 4 rotated at 35 degrees counterclockwise from the center position.
Figure 9:
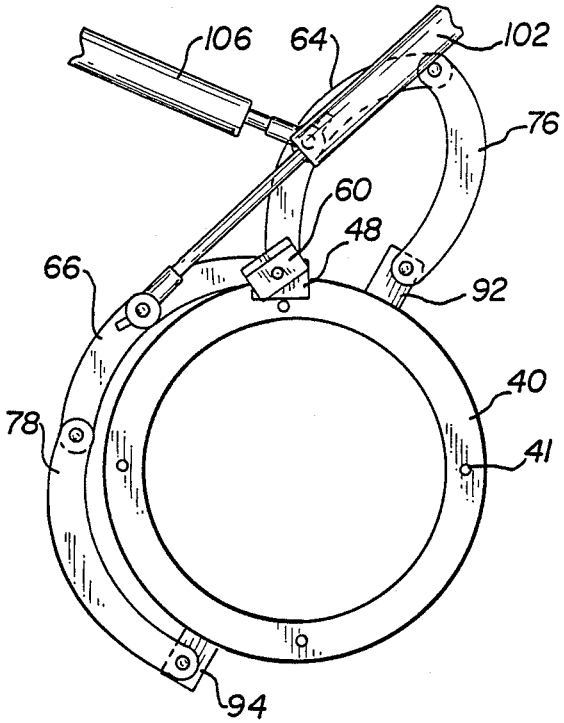
FIG. 9 is a top view of the auger swivel shown in FIG. 4 rotated at 60 degrees counterclockwise from the center position.
Figure 10:
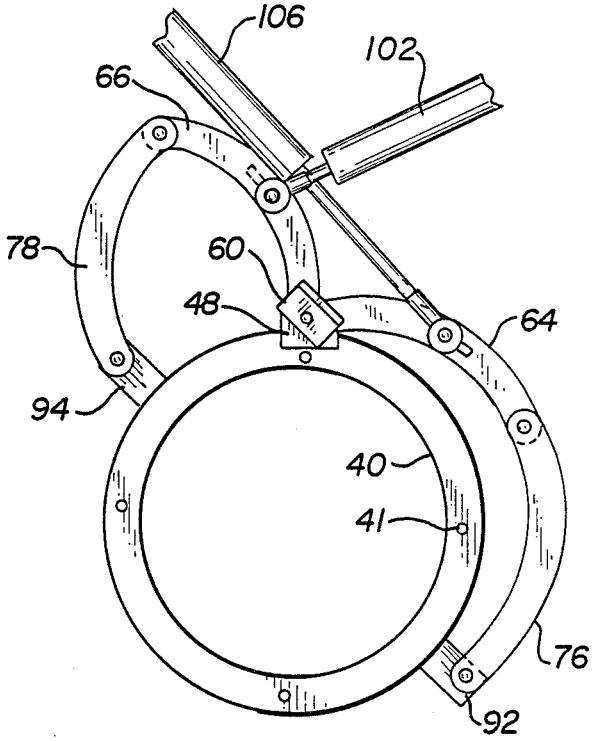
FIG. 10 is a top view of the auger swivel shown in FIG. 4 rotated at 35 degrees clockwise from the center position.
Figure 11:
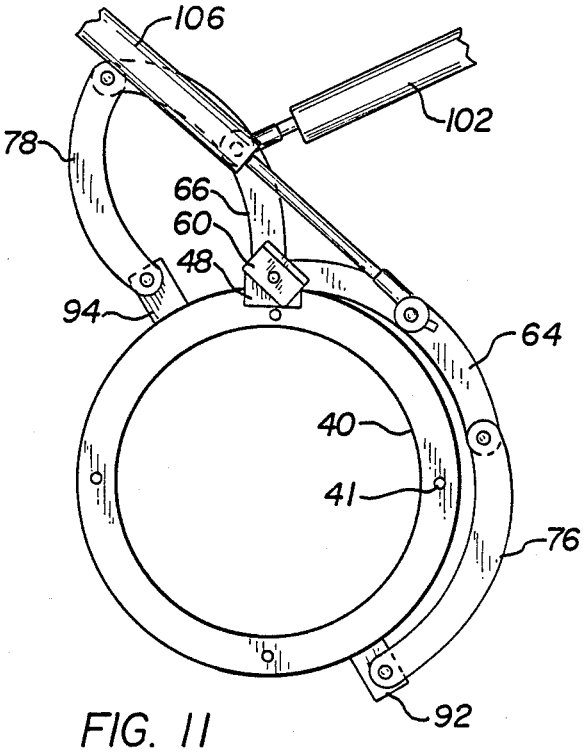
FIG. 11 is a top view of the auger swivel shown in FIG. 4 rotated at 60 degress clockwise from the center position.

In operation, the concrete mixer 2 is positioned so that the rear end 10 of the chassis 4 is near the delivery site. Typically at this point the dispensing end 26 of the mixing auger 20 is in an elevated position as shown in FIG. 1. Either hydraulic cylinder 102 or hydraulic cylinder 106 is activated and extends in an outward direction. This in turn forces the center member 62 to rotate about an axis passing through the pivot pin 54. The other hydraulic cylinder 106 or 102 is in turn forced into a retracted position. The forces from the extending hydraulic cylinder and retracting cylinder are transferred to related second wings 76 and 77 and 78 and 79, which transfer the forces to their respective tabs 92 and 94. This causes the sliding member 96 to rotate about the longitudinal axis passing through the bowl 18, which in turn causes the dispensing end 26 of the mixing auger 20 to rotate about the longitudinal axis passing through the bowl 18. As the sliding member 96 is rotated, one set of first wing and adjacent second wings is extended while the other set of first wing and second wings is retracted. This is shown in FIGS. 8–11. FIGS. 8 and 9 show the auger swivel 24 rotated 35 degrees and 60 degrees respectively, in a counter clockwise direction from the center position and FIGS. 10–11 show the auger swivel 24 rotated 35 degrees and 60 degrees, respectively, in a clockwise direction from the center position. When the dispensing end 28 of the mixing auger 20 is positioned over the work site hydraulic cylinders 102 and 106 are deactivated and the dispensing end 26 of the mixing auger 20 is lowered by activating and extending the hydraulic cylinder 28. The above described process is reversed after the concrete has been deposited at the work site so that the concrete mixer 2 can proceed to the next work site.

Having described the presently preferred embodiment of my invention, it is to be understood that it may otherwise be embodied within the scope of the appended claims.

I claim:

1. A swivel that rotates about a longitudinal axis passing through a cylindrically-shaped bowl comprising:

a channel attached to and extending substantially around the bowl;

a center member pivotally connected to a pivot point near said channel and near an outer surface of the bowl, said center member including a pair of first wings extending from said pivot point, opposite each other and away from the bowl;

two slides received in said channel and positioned away from each other by means for separating said slides;

two second wings each having two ends, one of said second wings being pivotally connected at one of its ends to one of said first wings and pivotally connected at its other end to one of said slides, the other of said second wings pivotally connected at one of its ends to the other of said first wings and pivotally connected at its other end to the other of said slides; and actuator means for rotating said center member about said pivot point and causing said slides to rotate around the outer surface of the bowl and about the longitudinal axis passing through the bowl.

2. The swivel of claim 1 wherein:

said two slides are integrally attached to a ring that is slidably received by said channel.

3. The swivel of claim 1 wherein said channel includes an upper bearing plate spaced from a lower bearing plate, with said bearing plates secured to an outer surface of said bowl.

4. The swivel of claim 1 wherein each of said first wings of said center member and each of said second wings has an inner surface in the shape of an arc of a circle approximately equal to or greater than the outer diameter of the cylindrical bowl.

5. The swivel of claim 1 wherein said actuator means includes two extending and retracting cylinders pivotally attached to a respective first wing whereby when one of said cylinders is extended the other of said cylinders is retracted causing said center member to rotate about an axis passing through said pivot point connecting said center member to said channel.

6. The swivel of claim 1 further comprising a mounting ear extending downwardly from each of said slides whereby a mixing auger may be mounted to said ears for movement about a longitudinal axis passing through the center of the bowl.

7. The swivel of claim 1 wherein said sliding members are diametrically opposed to each other.

8. The swivel of claim 2 wherein said ring has at least one groove facing said upper bearing plate and at least one groove facing said lower bearing plate, said bearing plates having bores therethrough in fluid communication with said grooves whereby lubricant can be urged through said bores and deposited into said grooves.

9. The swivel of claim 4 wherein said first wings and said second wings are approximately the same shape.

10. The swivel of claim 5 wherein said cylinders are hydraulically operated cylinders.

11. A swivel that rotates about a longitudinal axis passing through a cylindrically-shaped bowl comprising;

a channel attached to and extending substantially around the bowl;

a center member pivotally connected to a pivot point near said channel and near an outer surface of the bowl, said center member including a pair of first wings extending from said pivot point, opposite each other and away from the bowl;

a ring slidably received in said channel;

two tabs attached to said ring spaced substantially apart from each other; and two second wings each having two ends, one of said second wings pivotally connected at one of its ends to one of said first wings and pivotally connected at its other end to one of said tabs, the other of said second wings pivotally connected at one of its ends to the other of said first wings and pivotally connected at its other end to the other of said tabs;

actuator means for rotating said center member about said pivot point and causing said slide to rotate around the outer surface of the bowl and about the longitudinal axis passing through the bowl.

12. The swivel of claim 11 wherein said channel includes an upper bearing plate spaced from a lower bearing plate, with said bearing plates secured to an outer surface of said bowl.

13. The swivel of claim 11 wherein each of said second wings comprises an upper second wing and a lower second wing that sandwich said tab and said first wing to which they are pivotally attached.

14. The swivel of claim 11 wherein each of said first wings and each of said second wings have an inner surface in the shape of an arc of a circle approximately equal to or greater than the outer diameter of the bowl.

15. The swivel of claim 11 wherein said actuator means includes two extending and retracting cylinders pivotally attached to a respective first wing whereby when one of said cylinders is extended the other of said cylinders is retracted causing said center member to rotate about an axis passing through said pivot point connecting said center member to said channel.

16. The swivel of claim 11 further comprising a mounting ear extending downwardly from each of said tabs whereby a mixing auger may be mounted to said ears for movement about a longitudinal axis passing through the center of the bowl.

17. The swivel of claim 11 wherein said tabs are diametrically opposed to each other.

18. The swivel of claim 12 wherein said ring has at least one groove facing said upper bearing plate and at least one groove facing said lower bearing plate, said bearing plates having bores therethrough in fluid communication with said grooves whereby lubricant can be urged through said bores and deposited into said grooves.

19. The swivel of claim 14 wherein said first wings and said second wings are approximately the same shape.

20. The swivel of claim 15 wherein said cylinders are hydraulically-operated cylinders.

21. A concrete mixer mounted to the chassis of a vehicle comprising:

an aggregate bin mounted to the chassis;

a cement bin mounted to the chassis;

a conveyor located beneath and in fluid communication with said aggregate bin and said cement bin, said conveyor having a dispensing end;

a hollow bowl located beneath and in fluid communication with the dispensing end of the conveyor;

an auger swivel mounted to said bowl, said auger swivel including:

a channel attached to and extending substantially around the bowl;

a center member pivotally connected to a pivot point near said channel and near an outer surface of the bowl, said center member including a pair of first wings extending from said pivot point, opposite each other and away form the bowl;

two slides received in said channel and positioned away from each other by means for separating said slides;

two second wings each having two ends, one of said second wings being pivotally connected at one of its ends to one of said first wings and pivotally connected at its other end to one of said slides, the other of said second wings pivotally connected at one of its ends to the other of said first wings and pivotally connected at its other end to the other of said slides; and actuator means for rotating said center member about said pivot point and causing said slides to rotate around the outer surface of the bowl and about the longitudinal axis passing through the bowl; and a mixing auger having a receiving end mounted to said slides of said auger swivel, said mixing auger receiving end located beneath and in fluid communication with said bowl.

* * * * *